US005435329A

United States Patent [19]

Heck et al.

[11] Patent Number: 5,435,329

[45] Date of Patent: Jul. 25, 1995

[54] ARTIFICIAL NAIL APPLICATOR AND CLAMP

[76] Inventors: Linda Heck; Charles Heck, both of 3072 Magnolia Ct., Edgewood, Ky. 41017

[21] Appl. No.: 258,682

[22] Filed: Jun. 13, 1994

[51] Int. Cl.[6] ..... A45D 29/00

[52] U.S. Cl. ..... 132/200; 132/73

[58] Field of Search ..... 132/73, 73.5, 200; 24/489, 501, 507, 508, 521

[56] References Cited

U.S. PATENT DOCUMENTS

| | | | |
|---|---|---|---|
| 2,561,571 | 7/1951 | Haney | 132/73 |
| 2,666,240 | 1/1954 | Maccaferri | 24/501 |
| 3,060,637 | 10/1962 | Fumeaux | 24/507 |
| 4,135,526 | 1/1979 | Matranga et al. | 132/73 |
| 4,945,613 | 8/1990 | Ledermann | 24/501 |
| 5,027,839 | 7/1991 | Appell | 132/73 |

FOREIGN PATENT DOCUMENTS

| | | | |
|---|---|---|---|
| 909046 | 4/1946 | France | 24/501 |
| 935946 | 7/1948 | France | 24/508 |
| 540219 | 3/1956 | Italy | 132/73 |

*Primary Examiner*—Todd E. Manahan
*Attorney, Agent, or Firm*—Michael I. Kroll

[57] ABSTRACT

An artificial nail applicator consists of a top applicator tip having inner and outer surfaces and first and second ends and a bottom applicator tip having inner and outer surfaces and first and second ends. A spring clip is positioned between the inner surfaces of said top and bottom applicator tips.

6 Claims, 2 Drawing Sheets

ARTIFICIAL NAIL APPLICATOR AND CLAMP

BACKGROUND OF THE INVENTION

1. Field of the Invention

This invention relates to a device for applying and artificial fingernail.

This invention relates generally to a device for applying and artificial fingernail and more particularly, but not by way of limitation, to a device which firmly and securely holds an artificial fingernail in the proper place while artificial fingernail adhesive dries, thus, securely fastening said artificial fingernail to a real fingernail.

2. Description of the Prior Art

Presently used methods of applying fingernail adhesive and the like to a fingernail consist of placing the hand on which the nails are to be applied on a book or a table beneath a light in a room. After the nails have been treated with adhesive, the hand is moved rapidly back and forth or blown upon by the nail adhesive while pressure is applied to the artificial nail.

The above procedure results in an uneven, unprofessional-like application of the adhesive due to the fact that the pressure is insufficient to provide a proper adhesive forces on the nails and the fact that the adhesive ripples in an attempt to dry it.

The present invention is designed to easily hold and clasp on each nail for 5 to 10 seconds, releasing easily with no mess or glue sticking to the press or on the fingers.

The present invention also overcomes the problem of a person attempting to apply artificial nails on oneself, especially, to the opposite hand of a right or left handed person.

The present invention also would overcome the prior art drawback of waiting for several weeks for a beautician and/or technician to do the nails. If a person breaks a nail, seconds later, a new one can be applied by themselves.

The present invention is also great for travelling and busy women on the go as well as being less expensive than a beautician.

Numerous innovations for an artificial fingernail applicator have been provided in the prior art that are described as follows. Even though these innovations may be suitable for the specific individual purposes to which they address, they differ from the present invention as hereinafter contrasted.

U.S. Pat. No. 4,587,983

Lance R. Wissman, Sandra D. Bouwer, and Cheryl L. Jeluso

Method of installing an artificial toe or finger nail at the site of the surgical removal of the natural nail An initially plastic mass is interposed between an artificial nail and a toe or finger nail bed under gentle pressure, after applying a parting agent to the nail bed. The mass bonds to the nail, and separates from the nail bed at the parting agent as the nail and mass are removed. The parting agent is replaced by a clinical adhesive.

U.S. Pat. No. 4,547,363

Bernhard Joos

Preparation for strengthening, particularly hardening, living finger nails

Preparation for strengthening, particularly hardening living nails and method of using same which comprises the successive application of two separate product components. The first component contains, as a polymerizable compound, dimethylol ethylene thiourea, a purine, water and an organic solvent or blend of solvents miscible with water, said first component having a pH in the range of between 8 and 10. The second component contains, as a polymerizable catalyst, 0.1N to 0.5N hydrochloric acid, an amino acid, and an organic solvent or blend of solvents miscible with water, said second component having a pH in the range of between 1 and 3.

U.S. Pat. No. 4,017,923

Finger nail retainer and tweezers

John S. Schantz

A finger nail retainer and tweezers for use with a conventional nail clipper. The retainer and tweezers is used with a conventional nail clipper having a pair of elongated cutting blades fastened together at a rear end and having cutting blades at a forward end. The retainer and tweezers is made of spring steel and is of a generally V-shaped construction fitting over the pair of cutting blades and covering the space therebetween to retain nail clippings. The retainer and tweezers when removed from the nail clipper can be squeezed together and serve a particularly advantageous function as a tweezers. The retainer is simply adapted to be fitted over the nail clipper by inturned bottom flanges on the arms and inturned guide elements spaced above the flange elements to bit over the opposed sides of the bottom cutter blade while permitting the movement of the uppermost cutter blade. The flange form a narrow throat at the rear and an enlarged opening receiving a key ring. The throat restricts passage of the key ring but can be widened by spreading apart the retainer arms to pass the key ring to disengage the retainer therefrom.

U.S. Pat. No. 3,712,312

Self-sufficient Fingernail Treatment Salon

Morris Sussman

A self-sufficient finger-nail treatment salon in which the user is supplied with bottles of nail polish, nail-working tools, and means to illuminate the nails with light rays simulating the environmental conditions under which the nails will be exposed. The salon includes a console housing a bulb whose rays are selectively filtered to provide the desired illumination, and a blower drawing air heated by the bulb and directing it through an open-ended duct whose upper wall serves as a work counter for applying polish to the nails, the heated air discharged from the duct being used to dry the applied nail.

U.S. Pat. No. 4,255,871

Nail polish dryer

John J. Sigman

A nail polish dryer comprising an upwardly open bowl shaped body having a centrally located upward extension spaced inwardly from the periphery. The extension is provided with a support for the hand of the user which will position the nails of the thumb and fingers generally adjacent an annular space between the upward extension and the periphery of the body. Ports are provided surrounding the upward extension to direct drying air against the nails of the user. Preferably a switch activator is provided at the top of the upward extension adapted to be activated by the weight of the user's hand. A blower and preferably heating means are provided within the body and the blower directs heated air against the nails of the user.

U.S. Pat. No. 4,206,556

Nail polish machine

Paul F. Sabo

A device used for the application of fingernail polish and the like comprises a housing, a finger insert for positioning a finger on the housing, lighting means in the housing for providing direct illumination on the finger insert, a motorized fan for drying a polished fingernail, means for actuating the lighting means and the motorized fan, an air inlet in the housing for supplying air to the fan and an air outlet in the housing for directing air blown by the fan at the finger insert so that when a fingernail is polished it is quickly and easily dried without moving the finger to a new location.

Design U.S. Pat. No. D334590

Clamp for use in cosmetic schools for training in fingernail preparation

The ornamental design for a clamp for use in cosmetic schools for training in fingernail preparation, as shown and described.

U.S. Pat. No. 5,052,416

Control Improving Components For Fingernail Clippers

By providing separate, easily mountable members which incorporate finger/thumb receiving and holding zones constructed for use and access by individuals with reduced or impaired manual dexterity, a control improving and enhancing system is achieved which is mountable directly to conventional implements, such as manicure implements. Preferably, each control improving and enhancing system is constructed for being quickly and easily securely mounted to existing implements and may be removable therefrom for use on other implements. In addition, each control improving and enhancing system is constructed with enlarged, specially constructed, readily accessible, easily employable finger/thumb receiving and supporting zones which are positioned to assure complete operational control of the implement, thereby enabling individuals with reduced or impaired manual dexterity, or with varying stages of joint diseases, such as arthritis, to naturally and confidently use the implements.

Numerous innovations for an artificial fingernail applicator have been provided in the prior art that are adapted to be used. Even though these innovations may be suitable for the specific individual purposes to which they address, they would not be suitable for the purposes of the present invention as heretofore described.

SUMMARY OF THE INVENTION

The present invention is designed to easily hold and clasp on each nail for 5 to 10 seconds, releasing easily with no mess or glue sticking to the press or on the fingers.

The present invention also overcomes the problem of a person attempting to apply artificial nails on oneself, especially, to the opposite hand of a right or left handed person.

The present invention also would overcome the prior art drawback of waiting for several weeks for a beautician and/or technician to do the nails. If a person breaks a nail, seconds later, a new one can be applied by themselves.

The present invention is also great for travelling and busy women on the go as well as being less expensive than a beautician.

The novel features which are considered characteristic for the invention are set forth in the appended claims. The invention itself, however, both as to its construction and its method of operation, together with additional objects and advantages thereof, will be best understood from the following description of the specific embodiments when read and understood in connection with the accompanying drawing.

LIST OF REFERENCE NUMERALS UTILIZED IN THE DRAWING

10—artificial nail applicator
12—bottom applicator tip
14—top applicator tip
16—spring clip
16A—spring clip retaining bar
16B—spring clip retaining bar cross member
18—top applicator spring clip indent
18A—bottom applicator spring clip indent
20—top applicator artificial fingernail holder
22—bottom applicator artificial fingernail holder
24—top applicator middle section
26—bottom applicator middle section
28—tip small gap
30—tip large gap
32—fingernail holder small gap
32A—fingernail holder large gap curved bottom applicator fingernail holder section
36—gripping means
38—flat top applicator fingernail holder section
40—curved top applicator compression section
40A—curved bottom applicator compression section
42—right hand
44—left hand
46—left hand finger
48—left hand fingernail
50—left hand thumb nail
52—right hand index finger
54—right hand thumb

DETAILED DESCRIPTION OF THE PREFERRED EMBODIMENT

Figure 1:
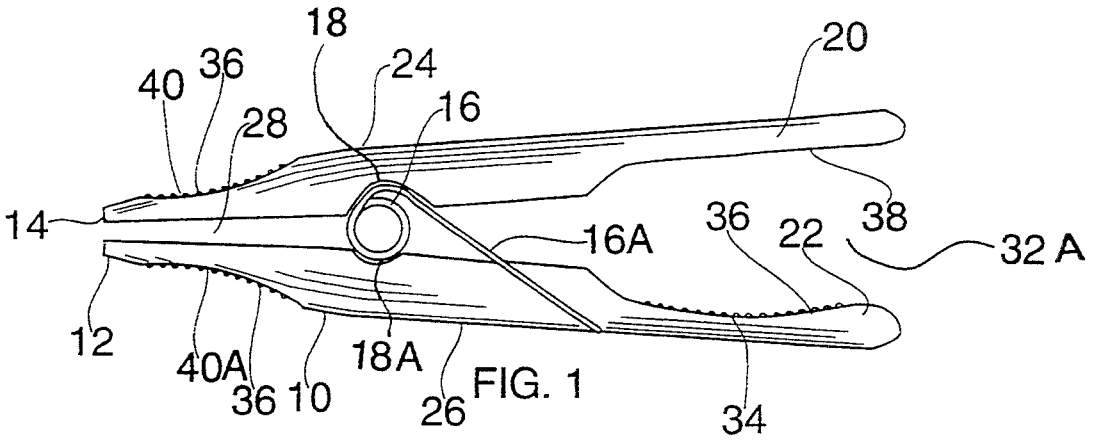
FIG. 1 shows a side view of the invention wherein a large fingernail holder gap is formed between the top and bottom applicator holder sections.

Firstly, referring FIG. 1 which is a side view of an artificial nail applicator 10 exhibiting the following features; bottom applicator tip 12, top applicator tip 14, spring clip 16, spring clip retaining bar 16A, top applicator spring clip indent 18, bottom applicator spring clip indent 18A, top applicator artificial fingernail holder 20, bottom applicator artificial fingernail holder 22, top applicator middle section 24, bottom applicator middle section 26, tip small gap 28, fingernail holder large gap 32A, gripping means 36, flat top applicator fingernail holder section 38, curved top applicator compression section 40, and curved bottom applicator compression section 40A. The artificial nail applicator 10 is utilized by exerting pressure on the curved top applicator compression section 40, and curved bottom applicator compression section 40A which in turn narrows the tip small gap 28, and simultaneously widens the fingernail holder large gap 32A, thus, allowing the insertion of a finger 52 or 46 containing a fingernail 48 or 50, to which is to be applied an artificial fingernail using adhesive.

Figure 2:
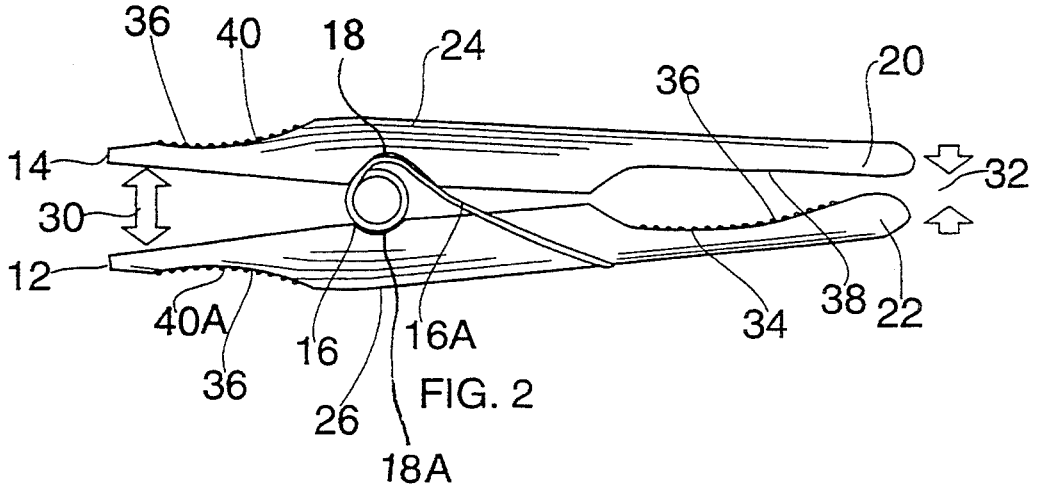
FIG. 2 shows a side view of the invention wherein a small fingernail holder gap is formed between the top and bottom applicator holder sections.

Referring now to FIG. 2 which is a side view of an artificial fingernail applicator 10 exhibiting the following features; bottom applicator tip 12, top applicator tip 14, spring clip 16, spring clip retaining bar 16A, top applicator spring clip indent 18, bottom applicator spring clip indent 18A, top applicator artificial fingernail holder 20, bottom applicator artificial fingernail holder 22, top applicator middle section 24, bottom applicator middle section 26, tip large gap 30, fingernail holder small gap 32, gripping means 36, flat top applicator fingernail holder section 38, curved top applicator compression section 40, and curved bottom applicator compression section 40A. The artificial nail applicator 10 is utilized by exerting pressure on the curved top applicator compression section 40, and curved bottom applicator compression section 40A which in turn narrows the tip small gap 28, and simultaneously widens the fingernail holder large gap 32A, thus, allowing the insertion of a finger 52 or 46 containing a fingernail 48 or 50, to which is to be applied an artificial fingernail using adhesive. When pressure is released from the curved top applicator compression section 40, and curved bottom applicator compression section 40A which in turn widens the tip large gap 30, and simultaneously narrows the fingernail holder small gap 32, thus, allowing the removal of a finger 52 or 46 containing a fingernail 48 or 50 to which has been attached an artificial fingernail.

Figure 3:
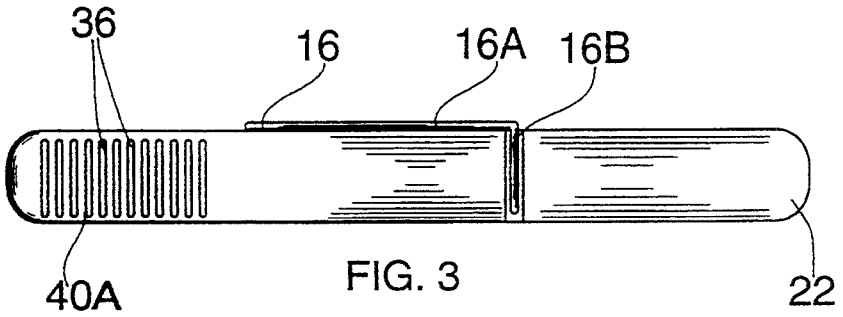
FIG. 3 shows a top view of the invention.

Referring now to FIG. 3 which is a top view of an artificial fingernail applicator 10 exhibiting the following features; spring clip 16, spring clip retaining bar 16A, spring clip retaining bar cross member 16B, bottom applicator artificial fingernail holder 22, gripping means 36, and curved bottom applicator compression section 40. The spring clip retaining bar cross member 16B allows for the narrowing and widening of the gaps 28, 30, 32A, and 32 for artificial fingernail application.

Figure 4:
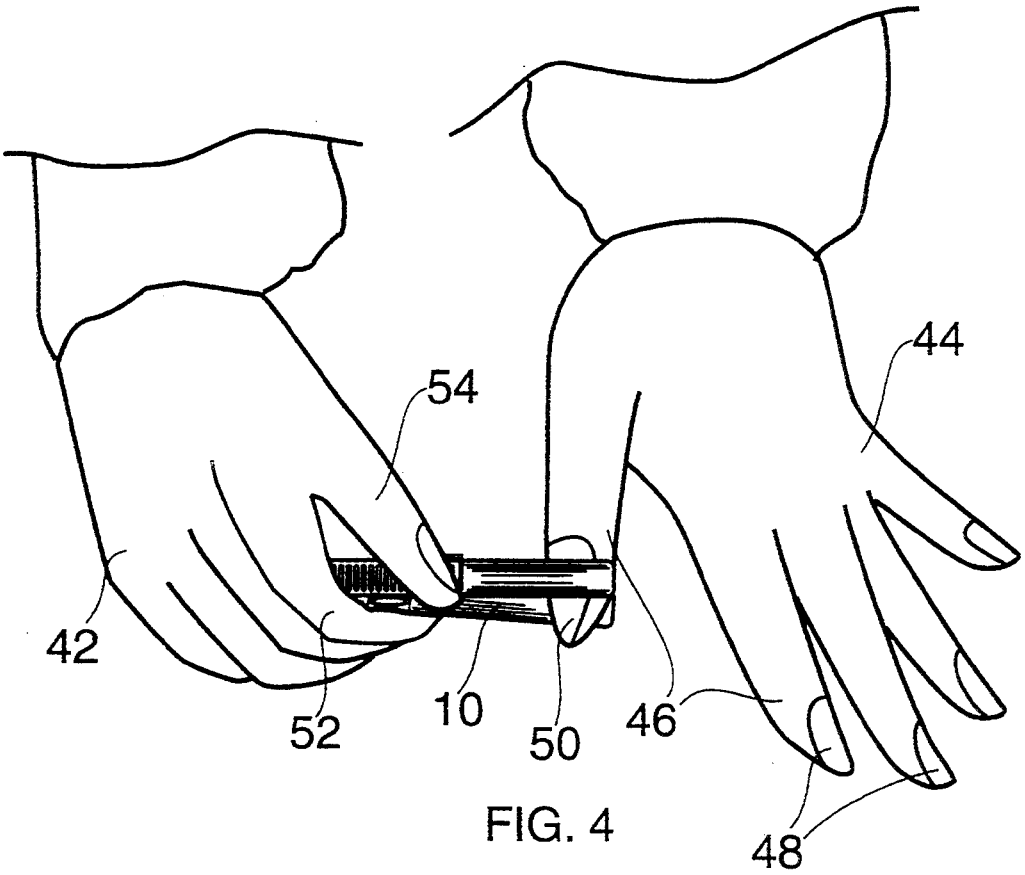
FIG. 4 shows a perspective view of the invention being utilized.

Referring now to FIG. 4 which is a perspective view of an artificial fingernail applicator 10 being utilized exhibiting the following features; right hand 42, left hand 44, left hand finger 46, left hand fingernail 48, left hand thumb nail 50, right hand index finger 52, and right hand thumb 54. The artificial nail applicator 10 is utilized by exerting pressure by virtue of the right hand thumb 54 and right hand finger 52 on the curved top applicator compression section 40, and curved bottom applicator compression section 40A which in turn narrows the tip small gap 28, and simultaneously widens the fingernail holder large gap 32A, thus, allowing the insertion of a finger 46 containing a fingernail 50, to which is to be applied an artificial fingernail using adhesive.

Figure 5:
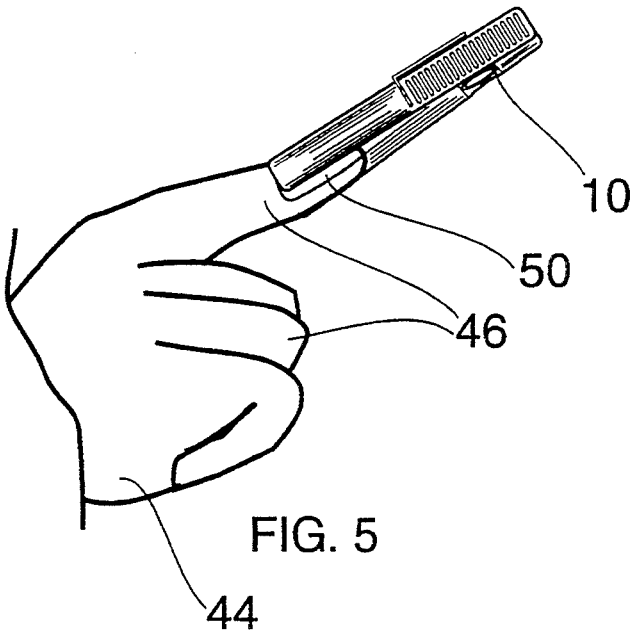
FIG. 5 shows a perspective view of the invention being utilized.

Referring now to FIG. 5 is a perspective view of an artificial fingernail applicator 10 being utilized exhibiting the following features; left hand 44, left hand finger 46, and left hand thumb nail 50. The artificial fingernail applicator 10 is utilized without additional help after it is securely fastened to the finger 46 holding the fingernail 50 to an artificial fingernail using adhesive.

It will be understood that each of the elements described above, or two or more together, may also find a useful application in other types of constructions differing from the type described above.

While the invention has been illustrated and described as embodied in an artificial fingernail applicator, it is not intended to be limited to the details shown, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

I claim:

1. An artificial fingernail applicator comprising:

a.) a top applicator tip having inner and outer surfaces and first and second ends, a concave top applicator compression section having gripping means thereon located on the outer surface of said top applicator tip at the first end thereof, a spring clip indent located in a middle section of said top applicator tip between the first and second ends, and a flat, planar top fingernail holder section on the inner surface of said top applicator tip at the second end thereof;

b.) a bottom applicator tip having inner and outer surfaces and first and second ends, a concave bottom applicator compression section having gripping means thereon located on the outer surface of said bottom applicator tip at the first end thereof, a spring clip indent located in a middle section of said bottom applicator tip between the first and second ends, and a concave bottom fingernail holder section having gripping means thereon located on the inner surface of said bottom applicator tip at the second end thereof; and c.) a spring clip positioned between the inner surfaces of said top and bottom applicator tips and retained in the spring clip indents, said spring clip pivotally attaching said top and bottom applicator tips together such that first gap is formed between the first ends of said top and bottom applicator tips and a second gap is formed between the planar top fingernail holder section and the concave bottom fingernail holder section;

whereby application of pressure to the compression section at the first ends of said top and bottom applicator tips thereby narrows the first gap therebetween and causes a simultaneous widening of the second gap between the top and bottom fingernail holder sections thereby allowing insertion therein of a person's fingernail having an artificial nail affixed thereto.

2. An artificial fingernail applicator as described in claim 1, wherein said spring clip has at least one spring clip retaining bar.

3. An artificial fingernail applicator as described in claim 2, wherein said at least one spring clip retaining bar has at least one spring clip retaining bar cross member.

4. An artificial fingernail applicator as described in claim 3, wherein said applicator has at least one applicator spring clip indent functioning to receive said at least one spring clip retaining bar therein.

5. An artificial fingernail applicator as described in claim 1, wherein said top and bottom applicator tips are manufactured from a material selected from the group consisting of wood, plastic, plastic composites, metal, metal alloys, ceramic, glass, fiberglass, petroleum derivatives, epoxy, carbon-graphite, rubber, and combinations thereof.

6. A method of applying an artificial fingernail comprising the steps of:

a.) providing an artificial fingernail applicator comprising:

i.) a top applicator tip having inner and outer surfaces and first and second ends, a concave top applicator compression section having gripping means thereon located on the outer surface of said top applicator tip at the first end thereof, a spring clip indent located in a middle section of said top applicator tip between the first and second ends, and a flat, planar top fingernail holder section on the inner surface of said top applicator tip at the second end thereof;

ii.) a bottom applicator tip having inner and outer surfaces and first and second ends, a concave bottom applicator compression section having gripping means thereon located on the outer surface of said bottom applicator tip at the first end thereof, a spring clip indent located in a middle section of said bottom applicator tip between the first and second ends, and a concave bottom fingernail holder section having gripping means thereon located on the inner surface of said bottom applicator tip at the second end thereof; and iii.) a spring clip positioned between the inner surfaces of said top and bottom applicator tips and retained in the spring clip indents, said spring clip pivotally attaching said top and bottom applicator tips together such that first gap is formed between the planar top fingernail holder section and the concave bottom fingernail holder section;

b.) applying adhesive to an inside concave surface of an artificial fingernail;

c.) placing the artificial fingernail having said adhesive applied thereto upon a convex surface of a person's fingernail;

d.) applying pressure to the compression sections of said applicator thereby widening said gap between said planar top fingernail holder section and said concave bottom fingernail holder section;

e.) inserting said person's finger having said artificial fingernail thereon into said gap and releasing the pressure on said compression sections thereby narrowing said gap so as to apply pressure to said person's fingernail having said artificial fingernail thereon and firmly attached said artificial fingernail to said person's fingernail; and f.) applying pressure to the compression sections of said applicator thereby widening said gap between said planar top fingernail holder section and said concave bottom fingernail holder section and removing said person's fingernail having said artificial fingernail attached thereto from said gap.

* * * * *